US007328647B2

(12) United States Patent
Achten

(10) Patent No.: US 7,328,647 B2
(45) Date of Patent: Feb. 12, 2008

(54) HYDRAULIC DEVICE

(75) Inventor: Peter A. J. Achten, Eindhoven (NL)

(73) Assignee: Innas B.V. (NL)

( * ) Notice: Subject to any disclaimer, the term of this patent is extended or adjusted under 35 U.S.C. 154(b) by 741 days.

(21) Appl. No.: 10/896,391

(22) Filed: Jul. 22, 2004

(65) Prior Publication Data

US 2005/0019171 A1 Jan. 27, 2005

(30) Foreign Application Priority Data

Jul. 25, 2003 (NL) ..... 1024002

(51) Int. Cl.
*F01B 3/00* (2006.01)
*F01B 1/00* (2006.01)
*F04B 1/12* (2006.01)

(52) U.S. Cl. ..... 91/502; 91/499; 92/72; 417/269

(58) Field of Classification Search ..... 91/499, 91/502, 171.1, 146; 417/269; 92/72
See application file for complete search history.

(56) References Cited

U.S. PATENT DOCUMENTS 3,434,429 A 3/1969 Goodwin ..... 103/162
3,648,567 A 3/1972 Clark ..... 91/505
4,223,594 A * 9/1980 Gherner ..... 91/504
4,776,257 A * 10/1988 Hansen ..... 92/12.2
5,794,514 A * 8/1998 Pecorari ..... 92/71
6,629,822 B2 * 10/2003 Larkin et al. ..... 417/203

FOREIGN PATENT DOCUMENTS

DE 2 130 514 12/1972
DE 35 19 783 12/1986

* cited by examiner

*Primary Examiner*—Charles G Freay
(74) *Attorney, Agent, or Firm*—St. Onge Steward Johnston & Reens LLC

(57) ABSTRACT

The invention concerns a hydraulic device with a housing and a rotor which can rotate in the housing and has fixedly mounted pistons. Around the piston there are drum sleeves which each, together with a piston, form a chamber of variable volume and which are supported by a drum plate with an axis which intersects the axis of the rotor at an angle. Clamping means hold the drum sleeve against the drum plate and the clamping means are designed in such a manner that the drum sleeves can make a movement along the drum plate which is double of the radial movement which occurs in the event of synchronous rotation between the drum plate and a drum sleeve.

5 Claims, 2 Drawing Sheets

HYDRAULIC DEVICE

Figure 1:
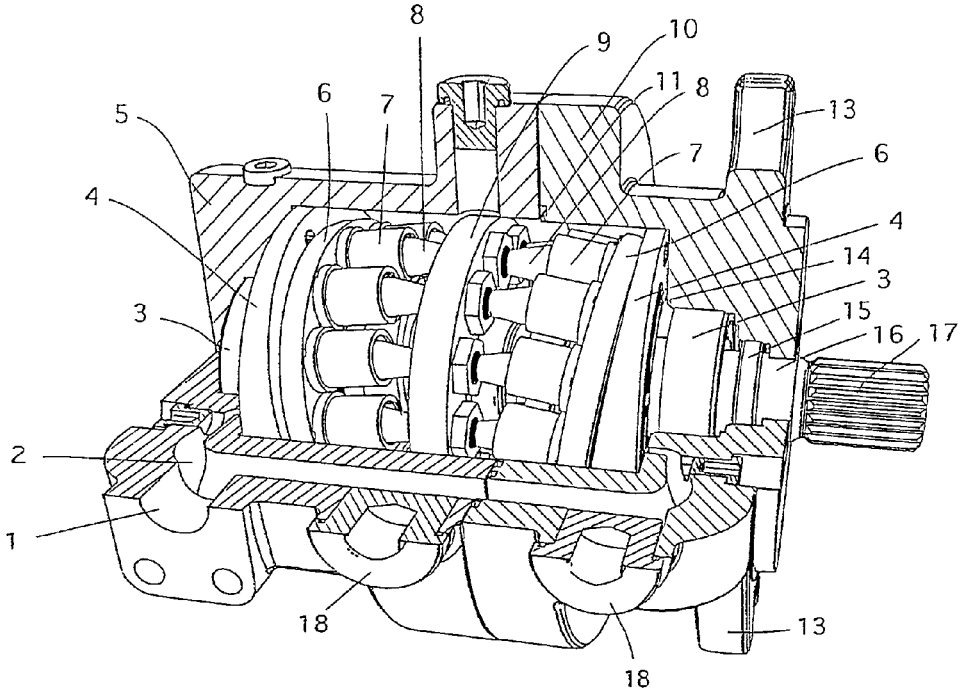

This application claims priority and the benefit thereof of Dutch Patent Application No. 1024002 filed Jul. 25, 2003.

BACKGROUND OF THE INVENTION

The invention relates to a hydraulic device in accordance with the preamble of Claim 1. The invention relates to a hydraulic device having a housing and a rotor which can rotate in the housing and has fixedly mounted pistons. A device of this type is known from application NL 1020932, which was not published before the priority date of the present application.

SUMMARY OF THE INVENTION

In the known application, the rotation of the drum plate is coupled to the rotation of the rotor by a key connection which couples the rotary position of the rotor and the drum plate at one or two diametrically opposite rotary positions. This local coupling with a key connection and the inclined position of the rotor and drum plate means that the rotational speed of the drum plate, unlike when a homokinetic coupling is used, is not constant if the rotational speed of the rotor is constant. Consequently, the movement of the drum sleeve fitted around the piston with respect to the drum plate in the tangential direction is double what would be expected for rotation at the same rotational speed as realized using a homokinetic coupling. If the simple coupling using the key connection is used, the doubled tangential movement which is then produced can cause the clamping means to limit the movement of the drum sleeve over the drum plate, with the result that it may collide with the clamping means. This can cause the drum sleeve to tilt, so that the seal between drum sleeve and drum plate is partially lost and additional leakage and noise pollution occurs.

To avoid this drawback, the device is designed in accordance with the characterizing clause of Claim 1. The result of this is that with a simple coupling of the rotation of the rotor to the drum plate, such as by a key connection, the drum sleeves can without obstacle follow the movement over the drum plate induced by the pistons. This improves the efficiency and reduces the noise pollution.

According to a refinement, the device is designed in accordance with Claim 2. The result of this is that even in the event of relatively extensive movements over the drum plate, the seal between the drum plate and the drum sleeve is fully retained under the influence of the pressure in the chamber.

According to a further refinement, the device is designed in accordance with Claim 3. As a result, the rotation of the rotor and drum plate is coupled by one or two drum sleeves, and there is no need for any additional coupling, such as a key connection.

According to a further refinement, the device is designed in accordance with Claim 4. This further prevents tilting of the drum sleeve with respect to the drum plate, thereby preventing leakage between drum plate and drum sleeve.

In accordance with a further refinement, the device is designed in accordance with Claim 5. This allows the drum sleeves to be secured using a component which is simple to produce and fit. The invention is explained below on the basis of a number of exemplary embodiments and with the aid of a drawing, in which:

DETAILED DESCRIPTION OF THE DRAWINGS

Figure 2:
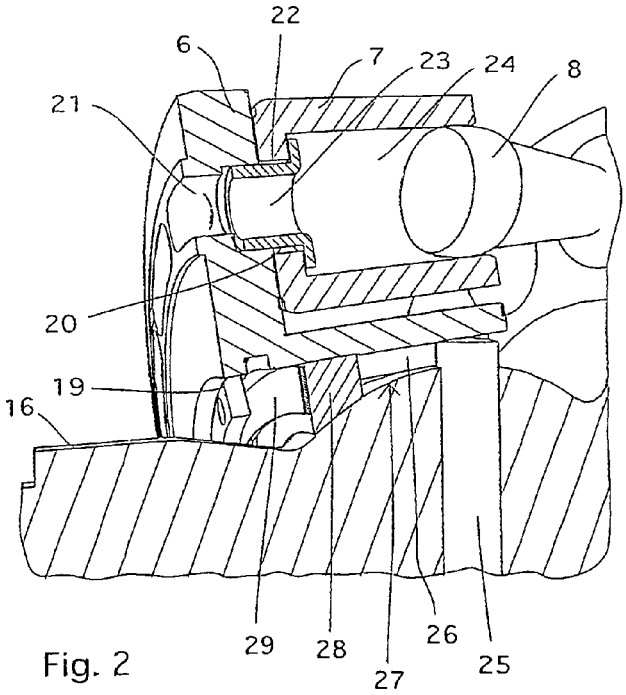
Figure 3:
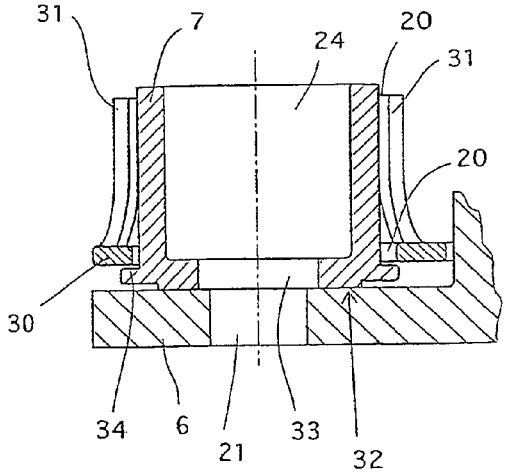
Figure 4:
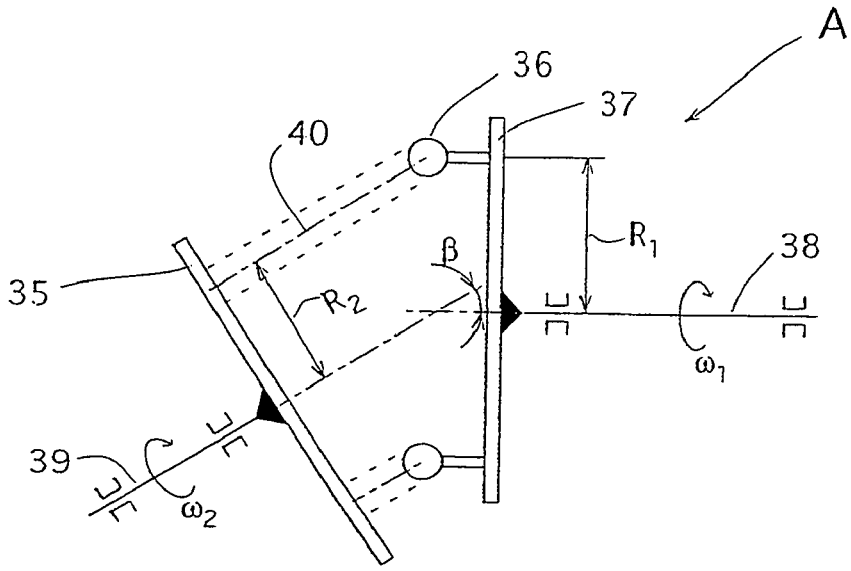
Figure 5:
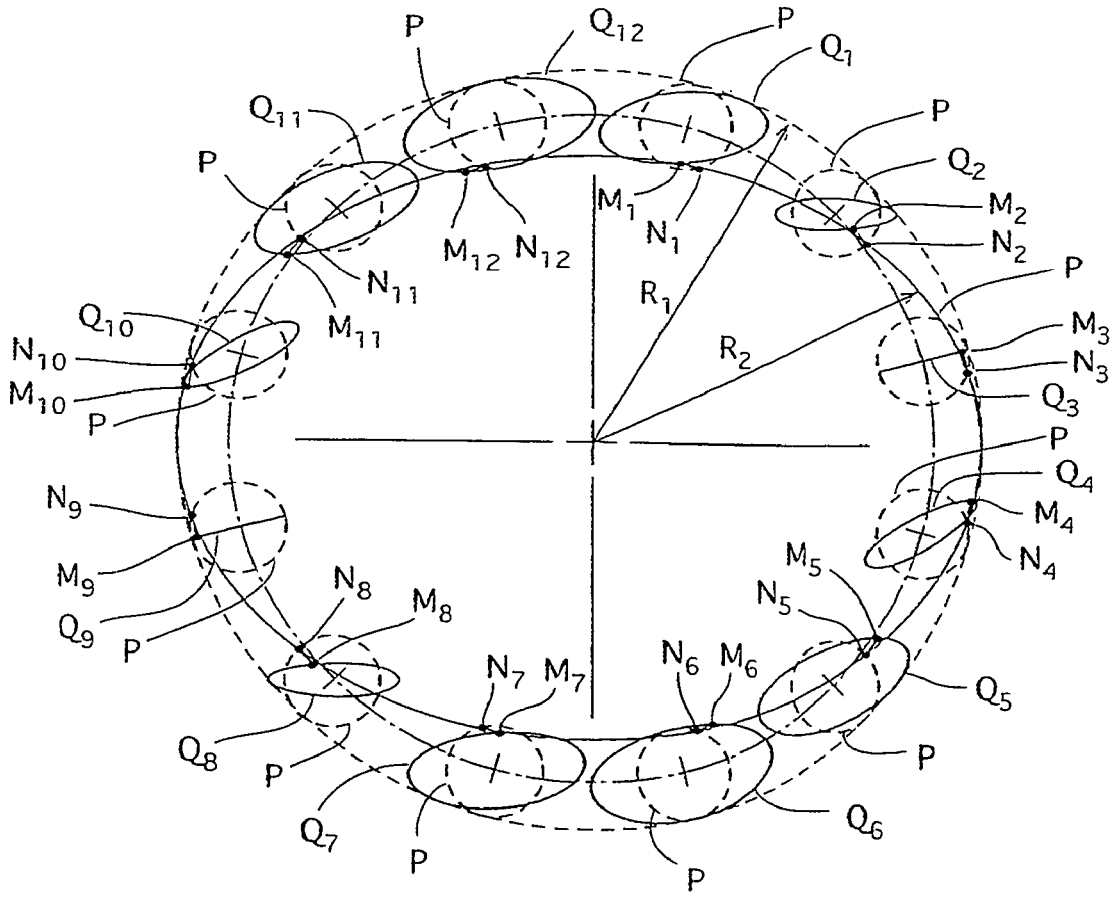

FIG. 1 shows a perspective cross section through a hydraulic device, such as a pump, FIG. 2 shows a detail of the drum sleeve of the hydraulic device shown in FIG. 1, FIG. 3 shows a second embodiment of a drum sleeve as can be used in the hydraulic device shown in FIG. 1, FIG. 4 diagrammatically depicts the way in which the rotor and drum plate of the hydraulic device shown in FIG. 1 move with respect to one another, and FIG. 5 shows, in view A from FIG. 4, the path of the drum sleeves over the drum plate.

FIGS. 1 and 2 show a hydraulic device which is described extensively, inter alia, in NL 1020932, the contents of which document are incorporated in the present description. The device shown can be used as a pump, in which case a drive (not shown) is coupled to splines 17 for rotating a shaft 16. The shaft 16 is mounted rotatably in bearings 3 which are respectively positioned in a first housing part 5 and a second housing part 10. A seal 15 is positioned at the location where the shaft 16 is led through an opening in the second housing part 10. The first housing part 5 and the second housing part 10 are coupled to one another using securing means (not shown); in the coupling surface, there is a groove with a sealing ring 11. The first housing part 5 and the second housing part 10 are provided in a known way with passages 2, line connections 1 and supports 13. Closure caps 18 are also fitted in a known way.

The shaft 16 is provided with a rotor 9 in which pistons 8 are arranged in such a manner that they project on both sides, so that the device is double-sided. A drum sleeve 7 is arranged in a sealing manner around each piston 8, with the drum sleeves 7 being supported against a drum plate 6 on the side remote from the piston 8. Each drum plate 6 is supported against an associated face plate 4 and can rotate about an axis of rotation, which axis of rotation intersects the axis of rotation of the shaft 16 at a small angle β; in the example shown, β is approximately 10 degrees. The drum plate 6 is centered around the shaft 16 and can in this case tilt about a convex pivot surface 28. In the drum plate 6 there is a keyway 26. A key pin 25 is secured in the shaft 16, fits into the keyway 26 and thereby couples the rotation of the drum plate 6 to the rotation of the shaft 16. A pressure ring 28 is pressed on by a spring plate 29 which is supported against a closure ring 19 and thereby ensures accurate positioning of the drum plate 6 in the axial direction.

The drum sleeve 7, together with the piston 8, forms a chamber 24, the volume of which varies during rotation of the rotor 9. Oil which is present in the chamber 24 can flow through a passage 23 and a drum plate port 21 through a face plate port 14 and via a passage 2 to a line connection 1. The drum sleeve 7 is dimensioned in such a manner that the drum sleeve presses onto the drum plate 6 under the influence of the pressure in the chamber 24. If there is as yet no oil pressure in the chamber 24 when the device is starting up or if this pressure is low and other forces acting on the drum sleeve 7 are relatively high, there is a risk of a gap forming between drum sleeve 7 and drum plate 6 as a result of the drum sleeve 7 for example tilting slightly. This is undesirable, since this can impede the build-up of pressure in the chamber 24, and to prevent this the drum sleeve 7 is secured to the drum plate 6 by a clamping sleeve 22; this clamping sleeve 22 is secured by a press fit or by adhesive bonding. A gap 20 between the outer side of the clamping sleeve 22 and the internal diameter of the drum sleeve 7 enables the drum sleeve 7 to slide over the drum plate 6. Tilting of the drum sleeves 7 is limited by the use of the clamping sleeves 22.

FIG. 3 shows a second exemplary embodiment of the way in which the drum sleeve 7 is secured to the drum plate 6. At the outer circumference, in the vicinity of the drum plate 6, the drum sleeve 7 is provided with a rim 34, and a plate, which is fixed in the axial direction in a manner which is not shown, is secured around the drum plate 6. The plate 30 is provided with poles in which the outer wall of the drum sleeve 7 fits with a gap 20. The rim 34 has a larger diameter than this hole, with the result that the drum sleeve 7 can be held against the drum plate 6 by the plate 30, thereby forming a sealing surface 32; the internal diameter of the sealing surface 32 is delimited by a passage 33. The drum sleeve 7 can slide through the gap 20 over the drum plate 6; the size of the gap 20 is such that the sealing surface 32 cannot slide over the edge of the drum plate port 21, since otherwise there is a risk of the force with which the drum sleeve 7 is pressed against the drum plate 6 under the influence of the oil pressure in chamber 24 being insufficient, which is unacceptable. If appropriate, supporting strips 31 may also be secured to the plate 30 and can engage all the way around on the top side of the drum sleeve 7 and inhibit tilting and/or clamping of the drum sleeve beneath the plate 30. There is also a gap 20 between the supporting strips 31 and the drum sleeve 7, so that sliding of the drum sleeve 7 along the drum plate 6 is not impeded. The supporting strips 31 may be secured to the plate 30 or produced therefrom by chipless deformation. If appropriate, the movement of the top side of the drum sleeve 7 may also be limited in other ways, for example by supports which are to be fitted separately.

The exemplary embodiments shown in FIGS. 1, 2 and 3 illustrate a hydraulic device with splines 17 which are to be driven, such as for example for a pump which is of double-sided design. It will be clear to the person skilled in the art that the design can also readily be used for hydraulic motors or hydraulic transformers, optionally single-sided or double-sided, or other structures which are mentioned, inter alia, in the incorporated document NL 1020932.

FIG. 4 diagrammatically depicts rotor 37 with a first axis of rotation 38. A number of pistons 36, in this case twelve such pistons, are positioned on the rotor 37, with the centre of the pistons being at a first distance $R_1$ from the axis of rotation 38. The rotor 37 rotates at a first rotational speed $w_1$. A diagrammatically depicted drum plate 35 rotates about a second axis of rotation 39 at a second rotational speed $w_2$. The first axis of rotation 38 and the second axis of rotation 39 intersect one another at an angle β. A line 40 indicates the projection of the centre of the piston 36 onto the drum plate 35; this line 40 corresponds to the centre of the drum sleeve which is arranged around the piston 36 and slides along the drum plate 35. There is a second distance $R_2$ between the line 40 and the second axis of rotation 39. The second distance $R_2$ is not constant, on account of the angle β, which is larger in the drawing shown here than the angle which will be used in practice.

FIG. 5 shows view A from FIG. 4, illustrating the path of the line 40 as a solid oval. The movement of the line 40 for each piston 36 with respect to the co-rotating drum plate 35 depends on the way in which the rotation of the rotor 37 is coupled to the rotation of the drum plate 35. If the first rotational speed $w_1$ is always equal to the second rotational speed $w_2$, if the rotor 37 is coupled to the drum plate 35 for example by a homokinetic coupling, the path of the centre of the piston 36, projected onto the co-rotating drum plate 35, is a circle which is indicated for each piston by a dashed line P, the centre for each piston being denoted by $N_1 \ldots N_2$. The diameter of this circle P is $R_1$-$R_1$ cos (β), which is in that case the maximum displacement of a drum sleeve over the drum plate.

If the rotation of the rotor 37 and the drum plate 35 are coupled by a cardan-joint coupling, as in the exemplary embodiment shown in FIGS. 1 and 2 with a simple key connection, the first rotational speed $w_1$. is not equal to the second rotational speed $w_2$, but the ratio between these two is dependent on the angle between the plane passing through the key and the second axis of rotation 39 and the plane passing through the first axis of rotation 38 and the second axis of rotation 39. The result of this speed profile is that the drum plate 35 is sometimes leading and sometimes trailing during a revolution, with the result that a projection of the centre $M_1 \ldots M_{12}$ of the piston 36 forms an oval path $Q_1 \ldots Q_{12}$ over the drum plate 36, with the paths Q differing for the different rotational positions of the piston 35. The paths $Q_3$ and $Q_9$ are for pistons 36 which lie in the plane of the key, and the drum sleeves around these pistons execute exclusively a radial movement with respect to the drum plate 35. The greatest length of a path Q is in the plane perpendicular to the plane passing through the key, and this length is double the diameter of the circle F, which means that when a cardan-joint coupling is used, the displacement of the drum sleeves over the drum plate is twice that produced if a homokinetic coupling is used. The play 20 between a drum sleeve and its clamping must in this case also be double, namely 2-($R_1$-$R_1$-cos(β)

On account of the fact that there are drum sleeves which execute exclusively a radial movement, these sleeves can be used to couple the rotation of the rotor 37 and drum plate 35 instead of the rotational coupling using a key. By providing drum sleeves which lie in a plane with play only in the radial direction and blocking them in the tangential direction with respect to the drum plate, it is possible for these drum sleeves to function as a key connection.

What is claimed is:

1. Hydraulic device comprising a housing with a rotor which can rotate in the housing about a first axis and has fixedly mounted pistons, a number of cylindrical drum sleeves which each, together with a fixed piston, form a chamber of variable volume, and a drum plate for supporting the drum sleeves on the side remote from the fixed pistons, the drum plate having a second axis, which intersects the first axis at an angle, and clamping means for holding the drum sleeves against the drum plate, characterized in that the clamping means are designed in such a manner that drum sleeves can move in the radial and tangential directions along the drum plate, and the movement in the tangential direction can be at least double the radial movement which occurs in the event of synchronous rotation between the drum plate and a drum sleeve as a result of the angle between the first axis and the second axis.

2. Hydraulic device according to claim 1, in which in the drum plate there are passages which are in communication with the chambers, and between a drum sleeve and the drum plate, around a passage, there is a circular sealing surface, and the clamping means are designed in such a manner that in the event of movement of the drum sleeve in the radial or tangential direction, the circular sealing surface remains outside the passage.

3. Hydraulic device according to claim 1, in which one or two drum sleeves positioned diametrically opposite one another can execute exclusively radial movement with respect to the drum plate.

4. Hydraulic device according to claim 1, in which the drum plate is provided with support means which can engage on those ends of the drum sleeves which face away from the drum plate.

5. Hydraulic device according to claim 4, in which the clamping means and the support means are combined to form a single component.

* * * * *